US008875822B2

(12) United States Patent
DeWeerdt

(10) Patent No.: US 8,875,822 B2
(45) Date of Patent: Nov. 4, 2014

(54) APPARATUS AND METHOD FOR PUMPING AIR FOR EXHAUST OXIDATION IN AN INTERNAL COMBUSTION ENGINE

(75) Inventor: Kevin R. DeWeerdt, Walled Lake, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 572 days.

(21) Appl. No.: 13/116,544

(22) Filed: May 26, 2011

(65) Prior Publication Data

US 2012/0298055 A1 Nov. 29, 2012

(51) Int. Cl.
*B60K 11/00* (2006.01)

(52) U.S. Cl.
USPC ..... 180/68.1; 180/68.2

(58) Field of Classification Search
USPC ..... 180/68.1, 68.2, 68.3, 68.4
See application file for complete search history.

(56) References Cited

U.S. PATENT DOCUMENTS

| | | | | |
|---|---|---|---|---|
| 4,128,363 | A * | 12/1978 | Fujikake et al. | 416/236 A |
| 6,123,051 | A * | 9/2000 | Kubina et al. | 123/41.49 |
| 6,601,546 | B1 * | 8/2003 | Mohr et al. | 123/41.49 |
| 6,827,547 | B2 * | 12/2004 | Robb | 415/1 |
| 6,896,095 | B2 * | 5/2005 | Shah et al. | 181/198 |
| 7,309,207 | B2 * | 12/2007 | Horski et al. | 415/119 |
| 7,588,419 | B2 * | 9/2009 | Hong et al. | 415/211.2 |
| 7,625,276 | B2 * | 12/2009 | Kim et al. | 180/68.1 |
| 7,654,793 | B2 * | 2/2010 | Savage | 415/208.2 |
| 7,832,981 | B2 * | 11/2010 | Hasan et al. | 415/119 |
| 8,454,300 | B2 * | 6/2013 | Stagg et al. | 415/58.5 |
| 8,475,111 | B2 * | 7/2013 | Stagg et al. | 415/1 |
| 2008/0284124 | A1 * | 11/2008 | Brady et al. | 180/291 |

* cited by examiner

*Primary Examiner* — Hau Phan
(74) *Attorney, Agent, or Firm* — Ralph E Smith

(57) ABSTRACT

An apparatus and method for producing air flow in a vehicle that uses a cooling fan for an engine of the vehicle. The cooling fan has plurality of blades, which define an outer perimeter of the fan. The apparatus also includes a housing surrounding at least a portion of the outer perimeter of the fan and a plurality of vanes between the housing and the fan. The vanes are revolved around the outer perimeter of the fan to direct air into the housing.

19 Claims, 5 Drawing Sheets

APPARATUS AND METHOD FOR PUMPING AIR FOR EXHAUST OXIDATION IN AN INTERNAL COMBUSTION ENGINE

FIELD

The present disclosure relates to an apparatus and method of reducing undesirable emissions from a vehicle, and more particularly to an apparatus and method of producing airflow for use during a cold start to reduce undesirable emissions.

BACKGROUND

Vehicles today employ various methods to reduce undesirable components of emissions. A catalytic converter is one component found in most vehicles that assists in reducing undesirable components found in vehicle emissions. One of the biggest shortcomings of the catalytic converter, however, is that it generally provides its highest efficiency at fairly high temperatures. This does not present a problem during normal operation of a vehicle because the heat generated by the vehicle's engine heats the catalytic converter. During a cold start of a vehicle, however, the engine is not able to heat the catalytic converter for a short period. During this short period, the catalytic converter does not operate at a desirable efficiency to reduce undesirable components in the vehicle's exhaust.

In one configuration to reduce emissions during a cold start, the temperature of the catalytic converter can be quickly raised without using heat generated by the engine. To raise the temperature of the catalytic converter in these situations, many vehicles are equipped with a secondary air system. The secondary air system typically includes a compact air pump that compresses and forces air into an exhaust manifold that contains the catalytic converter. As emissions from the engine enter the exhaust manifold, they encounter the compressed air and oxidize. The oxidation of the emissions quickly raises the temperature of the catalytic converter. This allows the catalytic converter to operate efficiently and reduce the toxicity of emissions even during a cold start. This efficiency comes at a price, however, since the required air pump tends to be expensive and at times unreliable. What is needed is a better way to supply compressed air to the exhaust manifold during a cold start to enable efficient operation of the catalytic converter.

SUMMARY

The present disclosure provides an apparatus for moving air in a vehicle. The apparatus includes a cooling fan for the vehicle's engine that has a plurality of blades. The plurality of blades defines an outer perimeter of the fan. The apparatus also includes a housing surrounding at least a portion of the outer perimeter of the fan and a plurality of vanes between the housing and the fan. The vanes revolve around the outer perimeter of the fan to direct air into the housing.

The housing may have an outlet, wherein the air directed into the housing is directed out the outlet. The air in the housing may be compressed before being directed out the outlet. The housing may include a varying cross sectional area for compressing the air. Further, the outlet may be directed to a secondary air system of the vehicle.

The apparatus may also include a motor for revolving the vanes and revolving the fan. The vanes may also be hinged to allow rotation between an open position and a closed position. Revolving the vanes in a first direction rotates the vanes to the open position. Revolving the vanes in a second direction rotates the vanes to the closed position. Additionally, revolving the fan in the second direction directs air to assist in cooling the engine.

The present disclosure also provides a method of moving air in a vehicle. The method includes revolving a plurality of vanes around a perimeter of a cooling fan for the vehicle's engine. The revolving vanes direct air into a housing surrounding the vanes. The method may further include compressing the air that enters the housing and outputting the compressed air through an outlet in the housing. The compressed air may be directed to a secondary air system of the vehicle. Further, the housing may compress the air entering the housing by having a varying cross sectional area.

The method may also include revolving the vanes and the fan using a single motor. The vanes used in the method may be hinged to allow rotation between an open position and a closed position. Revolving the vanes in a first direction rotates the vanes to the open position. Revolving the vanes in a second direction rotates the vanes to the closed position. Additionally, revolving the fan in the second direction directs air to assist in cooling the engine.

Further areas of applicability of the present disclosure will become apparent from the detailed description, drawings and claims provided hereinafter. It should be understood that the detailed description, including disclosed embodiments and drawings, are merely exemplary in nature and intended for purposes of illustration only, and are not intended to limit the scope of the invention, its application, or use. Thus, variations that do not depart from the gist of the invention are intended to be within the scope of the invention.

DETAILED DESCRIPTION

Figure 2:
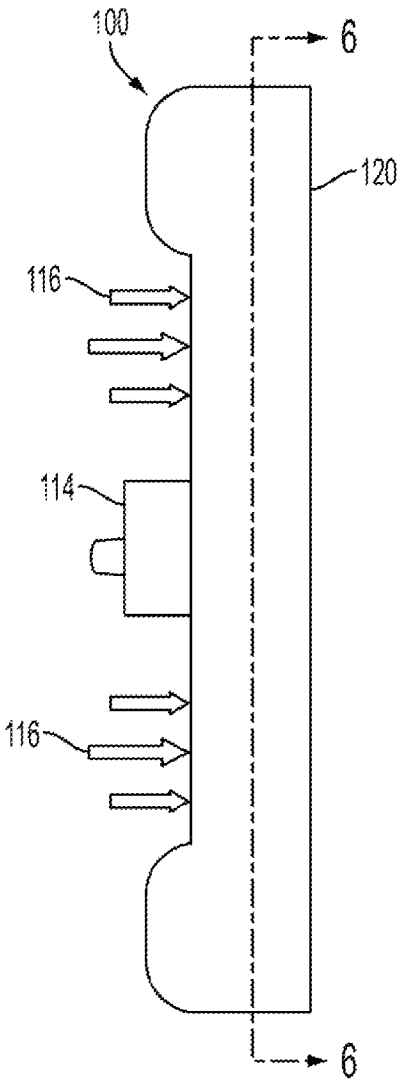
FIG. 2 is a side view of an exemplary air flow production system that incorporates the fan and vane support of FIG. 1.
Figure 1:
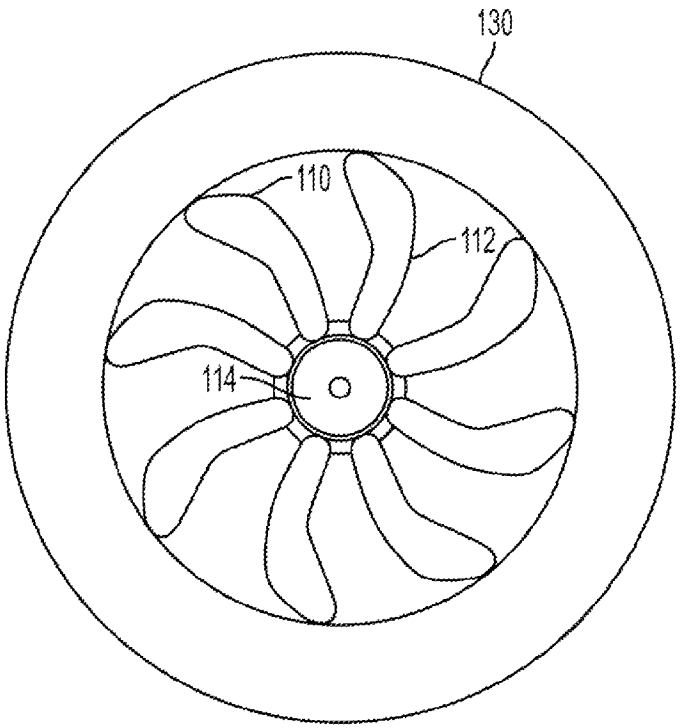
FIG. 1 is a front view of a exemplary fan with a surrounding vane system.
Figure 7:
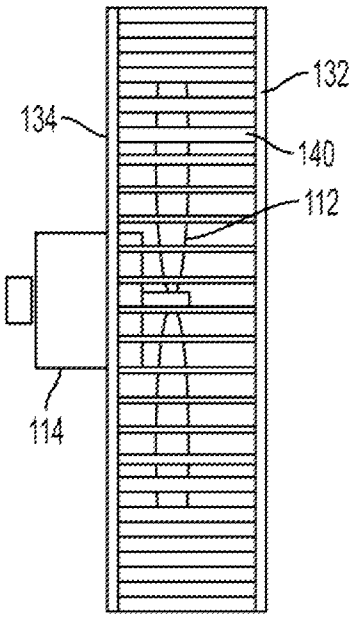
FIG. 7 is a side view of FIG. 1 with the vanes in the open position.

FIGS. 1 and 2 illustrate various components of an exemplary airflow production system 100 used in a vehicle. The system 100 includes a fan 110 with a plurality of fan blades 112 coupled to a motor 114. The motor 114 is in the center of the fan 110 and produces a force that revolves the blades 112. The fan 110 may be a radiator fan used in a vehicle's cooling systems. Alternatively, the fan 110 may have other configurations. The system 100 also includes a vane system 130 that is circular and surrounds the outer periphery of the fan 110. The vane system 130 has an open area and does not cover the face of the fan 110. The vane system 130 includes a front vane support 132, a back vane support 134, and a plurality of vanes 140 as illustrated in FIG. 7. The front vane support 132 and the back vane support 134 are both circular with open areas. Individual vanes 140 are coupled between the front and back vane supports 132, 134. The front and back vane supports 132, 134 support and retain the vanes 140 in place. The vanes 140 are described below in more detail with respect to FIGS. 4, 5, and 6.

The vane system 130 is coupled to the motor 114. As the motor 114 spins to revolve the fan blades 112, the motor 114 revolves the vane system 130. Alternatively, the vane system 130 may be coupled to and revolved by another motor that is not part of the fan 110. The vane system 130 may be coupled to the motor 114 by way of the fan blades 112. Each fan blade 112, at a point furthest from the fan motor 114, may be coupled to the vane system 130. Alternatively, supports may couple the vane system 130 to the motor 114 to allow the motor 114 to revolve the vane system 130. It should be understood that the disclosure should not be limited to how the vane system 130 is revolved around its center axis.

FIG. 2 illustrates a side view of system 100 with the periphery of the fan blades 112 and the vane system 130 surrounded by a housing 120. The motor 114 is shown in the middle of the housing 120. The housing 120 has an open area to allow airflow produced by the fan 110 to pass through. Arrows 116 show one direction of airflow produced by the fan 110 passing through the area of the housing 120.

Figure 4A:
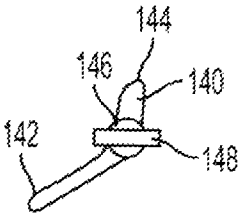
FIG. 4*a* is an exemplary rotatable hinged vane.
Figure 3:
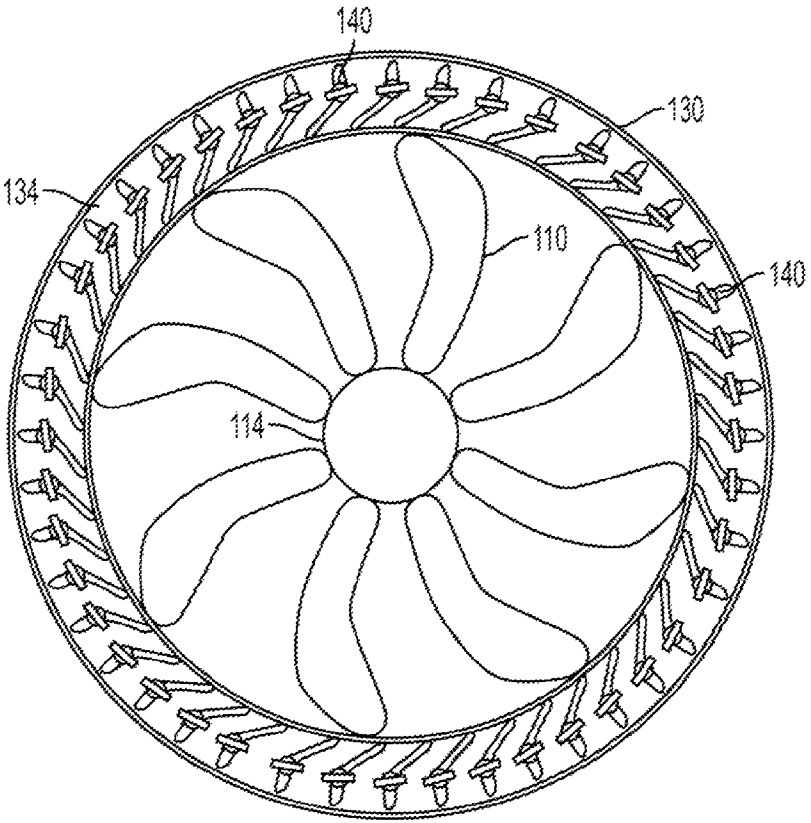
FIG. 3 is a front view of the fan of FIG. 1 with a front vane support removed to show the vanes.

FIG. 3 illustrates a view of the fan 110 surrounded by the vane system 130 with the front vane support 132 removed to expose the vanes 140 supported in the vane system 130. FIG. 4*a* illustrates an example of a rotatable vane 140. The vane 140 includes a first arm 142, a second arm 144, a hinge 146, and a flat 148. The first and second arms 142, 144 extend away from the circular hinge 146, with the first arm 142 being longer than the second arm 144. Each vane 140 has an axis of rotation around the hinge 146. The axis of rotation is offset from the center of the each vane 140 because the first and second arms 142, 144 are not the same length in this example. The flat 148 is coupled to the hinge 146 and has a rectangle shape.

Figure 5:
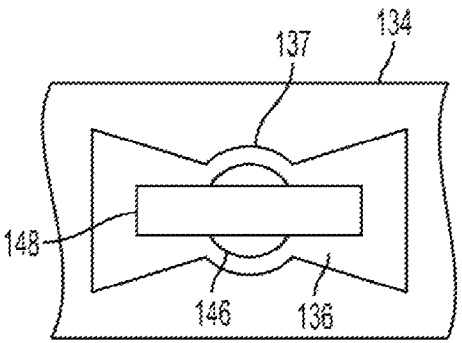
FIG. 5 is an exemplary cavity in a vane support that houses part of the vane of FIG. 4*a;*

The flat 148 and the hinge 146 of each vane 140 interact with a vane connector 136 (FIG. 5) on both the front and back vane supports 132, 134. In an illustrated embodiment, the vane connector 136 is a cavity within the front and back vane supports 132, 134 that has a bowtie shape with a circular middle 137 as illustrated in FIG. 5. The hinge 146 of each vane 140 rests in the middle 137 of the vane connector 136. This connection allows the vane 140 to rotate. The flat 148 also resides within the cavity of the vane connector 136. The flat 148 limits the rotation of the vane 140. As the vane 140 rotates around the hinge 146, the flat 148 rotates and meets a flat section of the vane connector 136, stopping the rotation of the vane 140. The shape of the vane connector 136 and the flat 148 may be modified to control the amount of rotation of each vane 140. It should be understood that the ability to control the rotation of a vane 140 is not limited to the vane 140 having a flat 148. Alternatively, the rotation of a vane 140 may be controlled by the vane 140 coming into contact with another vane 140 or by other means.

Figure 4B:
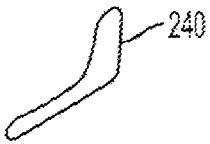
FIG. 4*b* is an exemplary fixed vane.

Alternatively, the vane system 130 may include fixed vanes 240 illustrated in FIG. 4*b*. Each fixed vane 240 has a shape similar to vanes 140, but does not include a hinge or a flat. The fixed vane 240 is instead rigidly coupled to the front and back vane support 132, 134 and does not rotate. The fixed vanes 240 are fixed in a position similar to the vanes 140 shown in FIG. 7.

Figure 6:
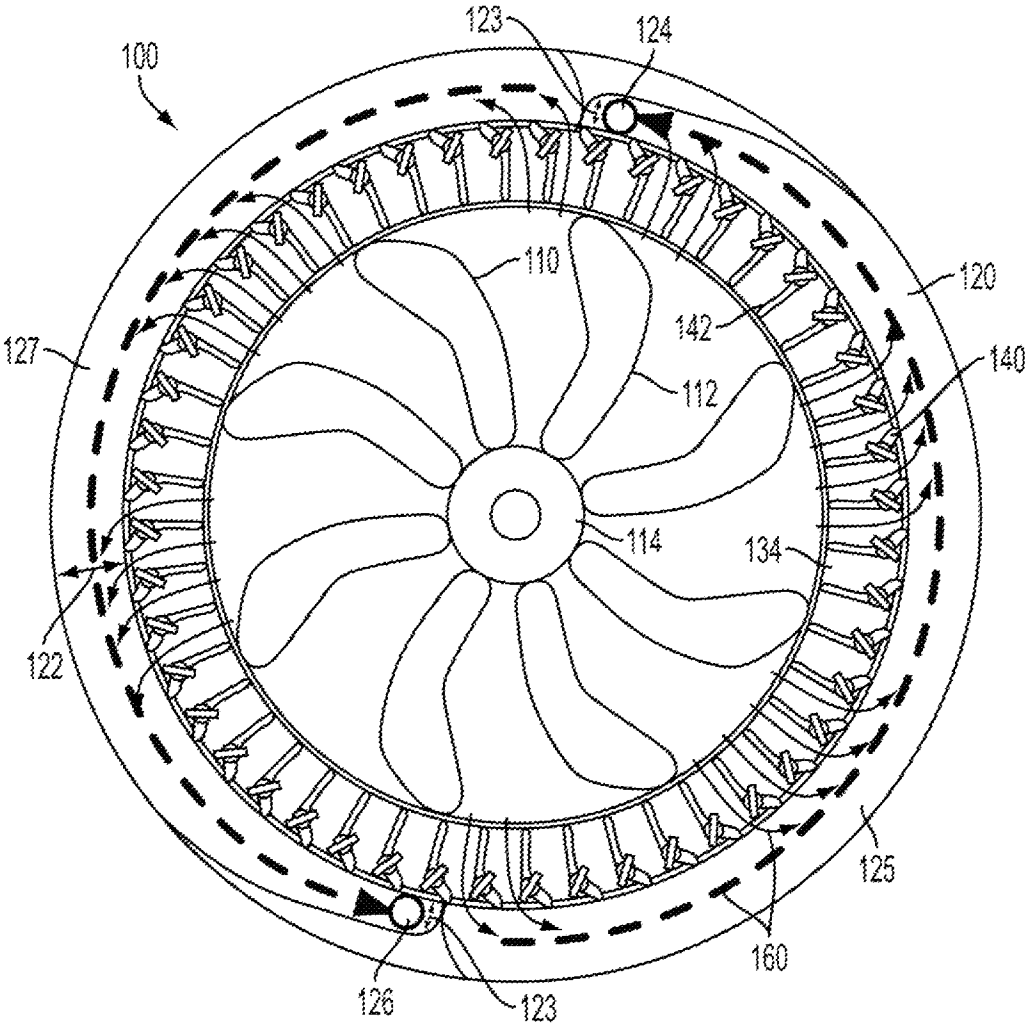
FIG. 6 is a front view of the air production system of FIG. 2 along the line 6, with the vanes in the open position.

FIG. 6 illustrates a cross-sectional view of the front of the system 100 taken along the line 6 of FIG. 2 and illustrates the internal part of the housing 120. The housing 120 is open next to the vane system 130 to receive airflow 160 directed, here pushed, by the vane system 130 into the housing 120. The housing 120 has a varying internal height 122 and first and second outlets 124, 126. The outlets 124, 126 are evenly spaced around the periphery of the housing 120 and are located in corresponding compression chambers 125, 127. The compression chambers 125, 127 equally divide the housing 120 in half. The height 122 within each compression chamber 125, 127 is at its peak at an end farthest from its respective outlet 124, 126. The height 122 of each compression chamber 125, 127 gradually decreases until it reaches a minimum height 123 near its respectively outlet 124, 126.

The varying height 122 of each compression chamber 125, 127 allow the compression chambers 125, 127 to compress air that is directed into the chambers 125, 127 by the vane system 130. The varying height 122 also allows the compression chamber 125, 127 to force the compressed air out the respective outlets 124, 126. It should be understood that system 100 is not limited to having two outlets 124, 126 and two compression chambers 125, 127. Nor is the system 100 limited to having the chambers 125, 127 and outlets 124, 126 equally spaced around the housing 120. Alternatively, the system 100 may have a single outlet and compression chamber. The system 100 may also have multiple outlets and chambers. Further, the chambers 125, 127 and outlets 124, 126 may be unevenly spaced around the housing 120.

In operation, system 100 moves air and then compresses it. To begin, the vane system 130 is revolved by the motor 114 in a counter-clockwise direction. The vane system 130 draws air from the area, e.g. center area, of the system 100 and directs the air into the housing 120 as shown by the airflow 160. Once inside the housing 120, the airflow 160 within compression chamber 125 is directed toward the outlet 124. As the airflow 160 flows along the compression chamber 125, the volume of the compression chamber 125 decreases as the height 122 decreases, thereby compressing the airflow 160. The compressed airflow 160 is then directed out of outlet 124. The airflow 160 within the compression chamber 127 is compressed and directed out the outlet 126 in a similar manner.

Figure 10:
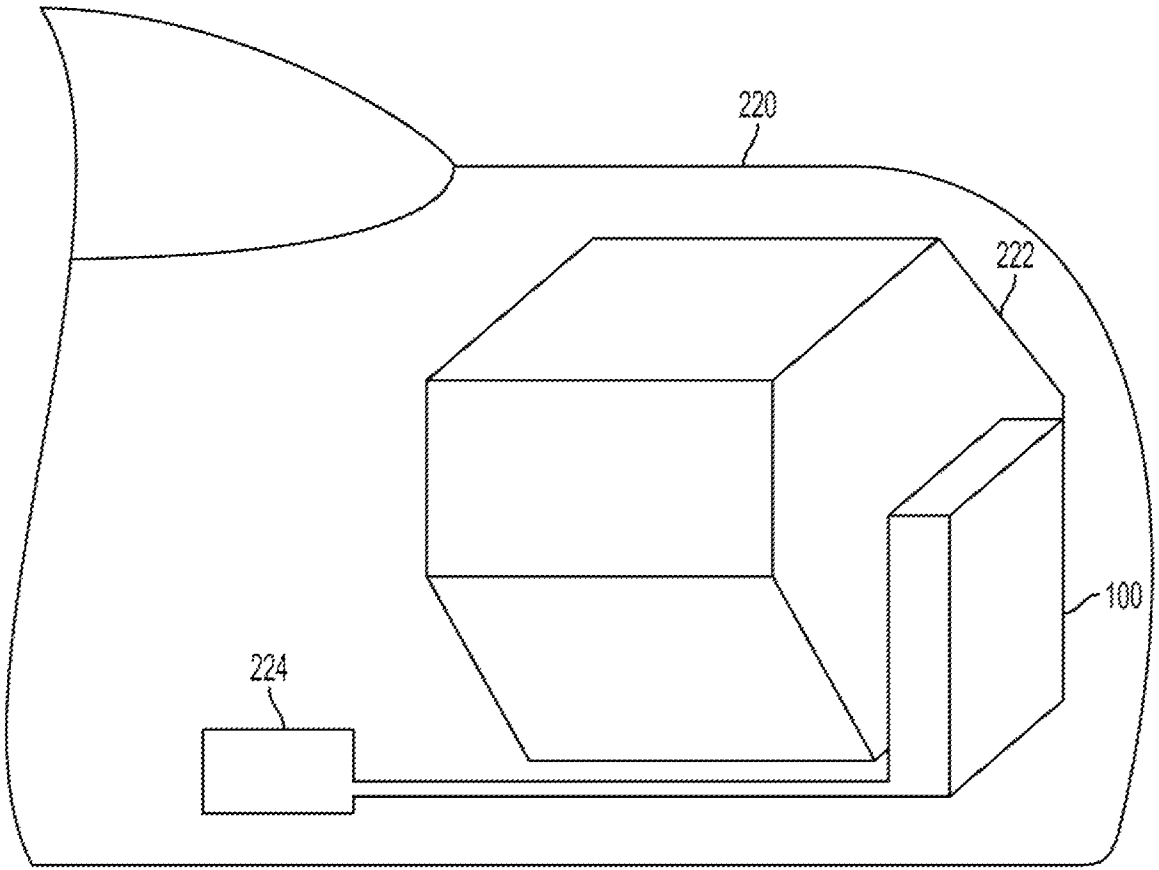
FIG. 10 is the air production system of FIG. 2 within a vehicle.

FIG. 10 illustrates the system 100 used in a vehicle 220 to compress air and to cool an engine 222 of the vehicle 220. The system 100 would be used on a cold start to provide compressed air to a secondary air system 224. For example, as shown in FIG. 6 and described above, when the fan 110 and the vane system 130 are rotated in a counter-clockwise direction, air is pushed into the housing 120, compressed and piped to the secondary air system 224. Either the hinged vanes 140 or the fixed vanes 240 may be used to direct air into the housing 120 where the air is compressed. The compressed air is used by the secondary air system 224 to quickly raise the temperature of the catalytic converter to reduce emissions on a cold start. Air is also directed by the fan 110 away from the engine 222 of the vehicle 220. After the catalytic converter's temperature is raised, the rotations of the fan 110 and vane system 130 are stopped.

After the engine 222 has been running, it may need to be cooled. The fan 110 of the system 100 is revolved in a clockwise direction to direct air to cool the engine 222. As a result, the vane system 130 is also rotated in a clockwise direction. If the fixed vanes 240 are part of the system 100, when the fan 110 rotates in a clockwise direction to direct air to cool the engine 222, the fixed vanes 240 direct some air into the housing 120. As a result, pressure builds and the pressure applies a force counter to the rotation of the fan motor 114.

The fan motor 114 must subsequently draw additional power from the engine 222 to overcome this force.

To eliminate the extra draw on the engine 222, the hinged vanes 140 should be used. As discussed above, each vane 140 is able to rotate around their respective hinge 146 and the hinge 146 is offset from the center of each vane 140 so that each vane 140 has an offset center of inertia. As a result, as shown in FIGS. 6 and 7, when the vane system 130 is rotated in the counter clockwise direction the centripetal force on each vane 140 rotates that vane 140. The vane 140 is rotated until the flat 148 contacts a portion of the vane connector 136. After being rotated, the vane 140 has its first arm 142 extending toward the motor 114 of the fan 110 and is in an open position. With the vanes 140 in the open position, the vane system 130 is able to direct air into the housing 120 where the air is compressed to aid in a cold start.

Figure 9:
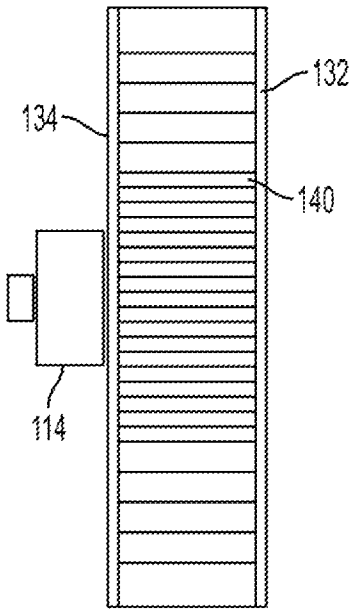
FIG. 9 is a side view of FIG. 1 with the vanes in the closed position.
Figure 8:
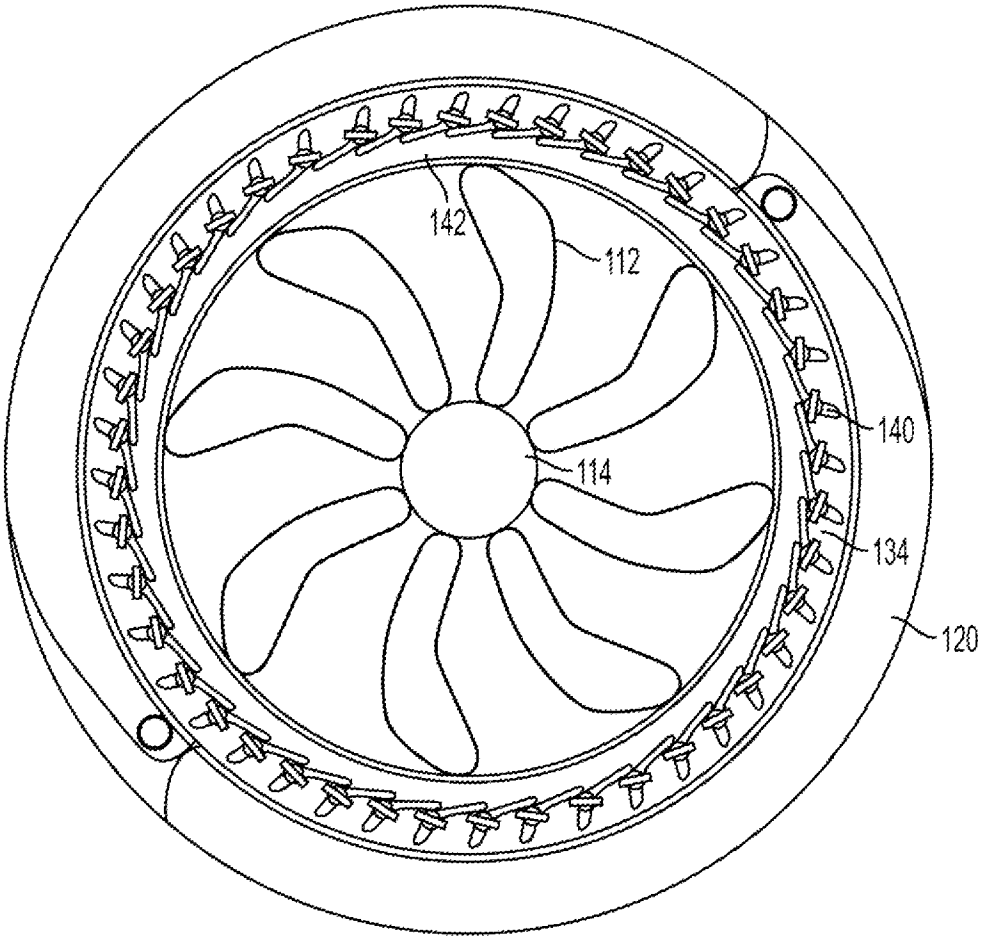
FIG. 8 is a front view of the air production system of FIG. 2 along the line 6, with the vanes in the closed position.

When the fan 110 is rotated in a clockwise direction to cool the engine 222, the vanes 140 also rotate. When the vanes 140 are rotated in a clockwise direction, the centripetal force rotates the vanes 140 in a direction opposite from when the vanes 140 are rotated in the counter-clockwise direction. Again, each vane 140 is rotated until the flat 148 contacts a portion of the vane connector 136. After being rotated, the first arm 142 of each vane 140 is folded up and in contact with another one of the vanes 140, closing the housing 120. FIGS. 8 and 9 illustrate the vanes 140 in the closed position. As a result, the vane system 130 does not direct air into the housing 120 and no additional force is placed on the motor 114 when the fan 110 is used to cool the engine 222. It should be understood that system 100 may be designed to produce compressed air when the vanes 140 are rotated in either the clockwise or counter-clockwise direction.

The system 100 offers various advantageous because little additional space is required to generate the compressed air for a cold start because the system 100 utilizes many components from the vehicle's 220 existing cooling system, namely a fan 110 and a housing 120. Further, the additional component costs are reduced compared to known systems. Moreover, the system 100 has higher reliability and requires less energy draw than existing systems.

What is claimed is:

1. An apparatus for moving air in a vehicle comprising:

a cooling fan for an engine of the vehicle having a plurality of blades, the plurality of blades defining an outer perimeter of the fan;

a housing surrounding at least a portion of the outer perimeter of the fan, said housing including one or more compression chambers each extending along a circumferential direction of said housing and having a cross-sectional area that varies in the circumferential direction; and a plurality of vanes between the housing and the fan, the vanes revolving around the outer perimeter of the fan to direct the air into the one or more compression chambers of said housing.

2. The apparatus of claim 1, wherein each of the one or more compression chambers has an outlet and the air in the compression chambers is directed out the outlets.

3. The apparatus of claim 2, wherein the air in the compression chambers is compressed before being directed out the outlets.

4. The apparatus of claim 3, wherein the compression chambers each have a decreasing cross sectional area that compresses the air within the compression chambers.

5. The apparatus of claim 2, wherein the air is directed out the outlets to a secondary air system of the vehicle.

6. The apparatus of claim 1, wherein a motor revolving the vanes also revolves the fan.

7. The apparatus of claim 6, wherein the vanes are hinged to allow rotation between an open position and a closed position.

8. The apparatus of claim 7, wherein revolving the vanes in a first direction rotates the vanes to the open position.

9. The apparatus of claim 8, wherein revolving the vanes in a second direction rotates the vanes to the closed position.

10. The apparatus of claim 8, wherein revolving the fan in a second direction directs air to assist in cooling the engine.

11. A method of moving air in a vehicle comprising:

revolving a plurality of vanes around a perimeter of a cooling fan for an engine of the vehicle, the cooling fan having a plurality of blades, the revolving vanes directing the air into one or more compression chambers in a housing at least partially surrounding the vanes, the vanes being between the housing and the cooling fan, each of the one or more compression chambers extending along a circumferential direction of said housing and having a cross-sectional area that varies in the circumferential direction.

12. The method of claim 11, further comprising compressing the air that enters the one or more compression chambers.

13. The method of claim 12, further comprising outputting the compressed air through an outlet in each compression chamber.

14. The method of claim 13, wherein the compressed air is directed to a secondary air system of the vehicle.

15. The method of claim 12, wherein the compression chambers each include a decreasing cross sectional area for compressing the air.

16. The method of claim 11, wherein the vanes are hinged to allow rotation between an open position and a closed position.

17. The method of claim 16, wherein revolving the vanes in a first direction rotates the vanes to the open position.

18. The method of claim 17, wherein revolving the vanes in a second direction rotates the vanes to the closed position.

19. The method of claim 17, wherein revolving the fan in a second direction blows air to assist in cooling the engine.

* * * * *